US005088951A

United States Patent [19]

Majurinen

[11] Patent Number: 5,088,951

[45] Date of Patent: Feb. 18, 1992

[54] BUILDING BLOCK SYSTEM MAGNETIC

[75] Inventor: Joel Majurinen, Espoo, Finland

[73] Assignee: Insinooritoimisto Joel Majurinen KY, Helsinki, Finland

[21] Appl. No.: 610,411

[22] Filed: Nov. 7, 1990

[30] Foreign Application Priority Data

Nov. 8, 1989 [FI] Finland ..... 895317

[51] Int. Cl.[5] ..... A63H 33/04; A63H 33/06; A63H 33/26

[52] U.S. Cl. ..... 446/91; 446/118; 446/129; 446/137

[58] Field of Search ..... 446/91, 92, 129, 130, 446/131, 132, 133, 134, 135, 136, 137, 138, 139, 117, 118

[56] References Cited

U.S. PATENT DOCUMENTS

| | | | |
|---|---|---|---|
| 2,600,951 | 6/1952 | Edwards | 446/129 X |
| 3,210,080 | 10/1965 | Rael et al. | 446/138 X |
| 3,237,345 | 3/1966 | Feliziani | 446/130 |
| 3,594,940 | 7/1971 | Yonezawa | 446/118 |
| 3,744,795 | 7/1973 | Lipscomb | 446/136 X |
| 4,878,878 | 11/1989 | Bittner | 446/134 X |

FOREIGN PATENT DOCUMENTS

| | | | |
|---|---|---|---|
| 688911 | 6/1964 | Canada | 446/92 |
| 689961 | 7/1964 | Canada | 446/92 |
| 2248688 | 10/1972 | Fed. Rep. of Germany | 446/92 |
| 2569126 | 2/1986 | France | 446/92 |

*Primary Examiner*—David N. Muir
*Attorney, Agent, or Firm*—Pettis & McDonald

[57] ABSTRACT

Building block system, magnetically held together, comprising a base plate (1) and at least one building block (2). The base plate (1) comprises a magnetizable metal core (3) and at least one building block (2) comprises at least one magnetizable metallic joining element (4) placed inside the building block. The metal core (3) of the building block system is preferably electrically magnetizable and the parts of the system have smooth surfaces.

9 Claims, 2 Drawing Sheets

BUILDING BLOCK SYSTEM MAGNETIC

BACKGROUND OF THE INVENTION

1. Field Of The Invention

The invention relates to a building block system comprising building blocks magnetically joined together. This kind of block systems are suitable for use as toys and for building scale models.

2. Description Of The Prior Art

Known building block systems generally consist of cubic blocks, the sides of which are provided with recesses and corresponding protruding parts to facilitate joining of a block to another block or to the base plate. Joining is normally based on compression which results, during connecting of the parts, as the sides of the protruding parts are pressed against the sides of the recesses. These kind of building blocks must be manufactured with great care in order to join the blocks together properly.

In assembling scale models and various constructions, the peg-like protrusions and recesses impede the construction work since it is impossible to remove a block from the middle without dismantling the construction so that there are limited possibilities to make modifications during the work. Also in this kind of system, the blocks must have a uniform shape, at least at the point where the blocks join together, which restricts the possibilities of manufacturing blocks with various sizes and shapes.

Furthermore, there are known systems where blocks are joined together by permanent magnets. Each building block accommodates a magnet attracting each other so that joining of the blocks takes place readily. The drawback with these blocks is their high price and the fact that blocks tend to entangle with each other prior to assembly due to the magnetic forces, which impedes the construction work.

SUMMARY OF THE INVENTION

The above described difficulties have been overcome by the current invention by using a building block system which contains a magnetizable metal core forming the base plate and each building block containing at least one magnetizable, metallic joining element placed inside the building block.

In the building block system according to the invention, there is no need to have any protrusions and grooves to establish the joint. Magnetic forces are utilized in joining the blocks but joining is not performed until the construction is completed or at some other suitable stage. The blocks themselves do not attract each other unless the base is magnetized. The blocks have a smooth surface and so it is possible to remove blocks from the construction without collapsing the construction. Furthermore, shape of the blocks can be freely chosen, their surface can be curved or they can be regular cubes. The connecting area can be nearly as small as a point and, nevertheless, be sufficient for joining the blocks together

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
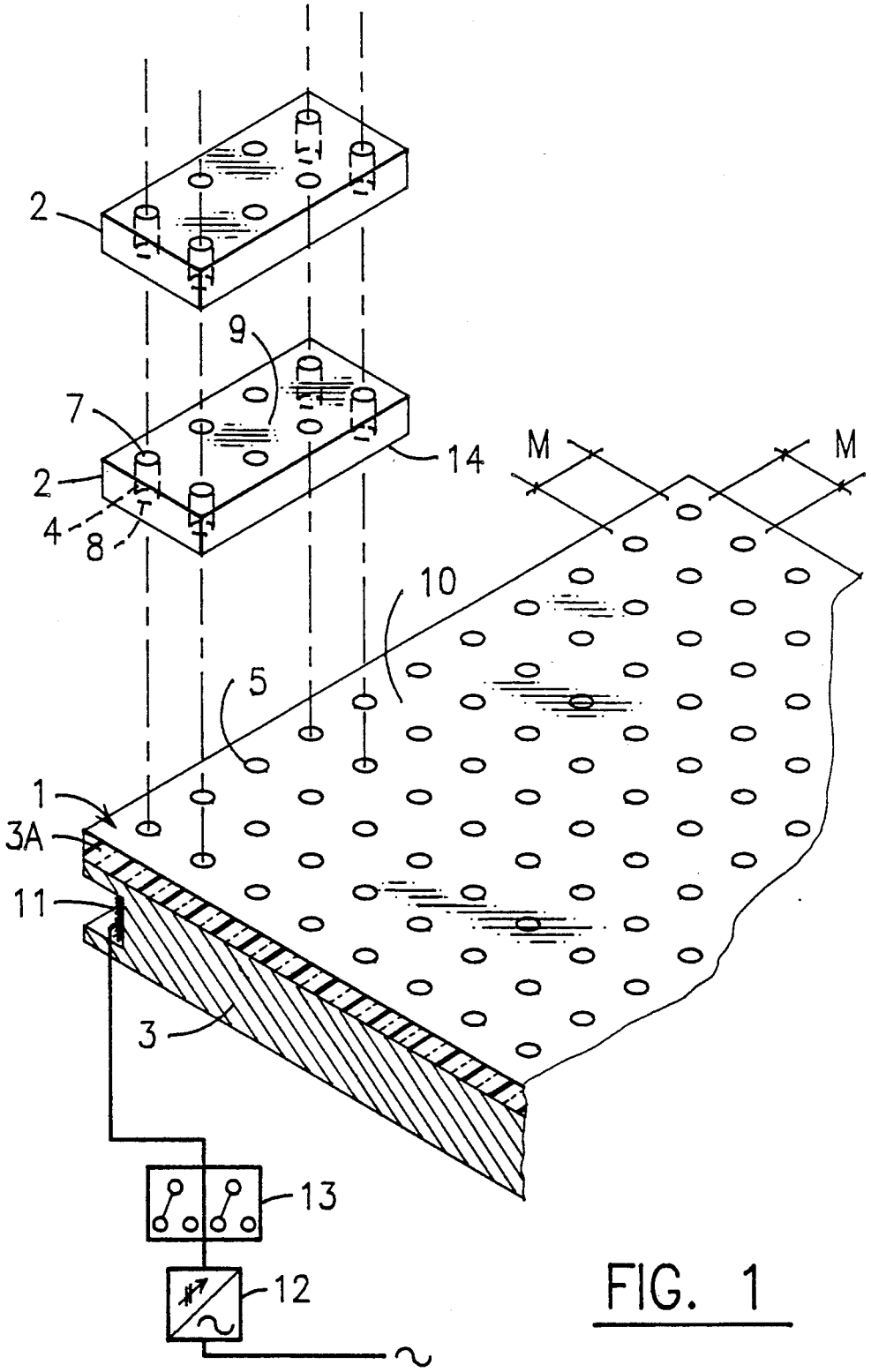
FIG. 1 is an enlarged fragmentary view of the building block system.
Figure 2:
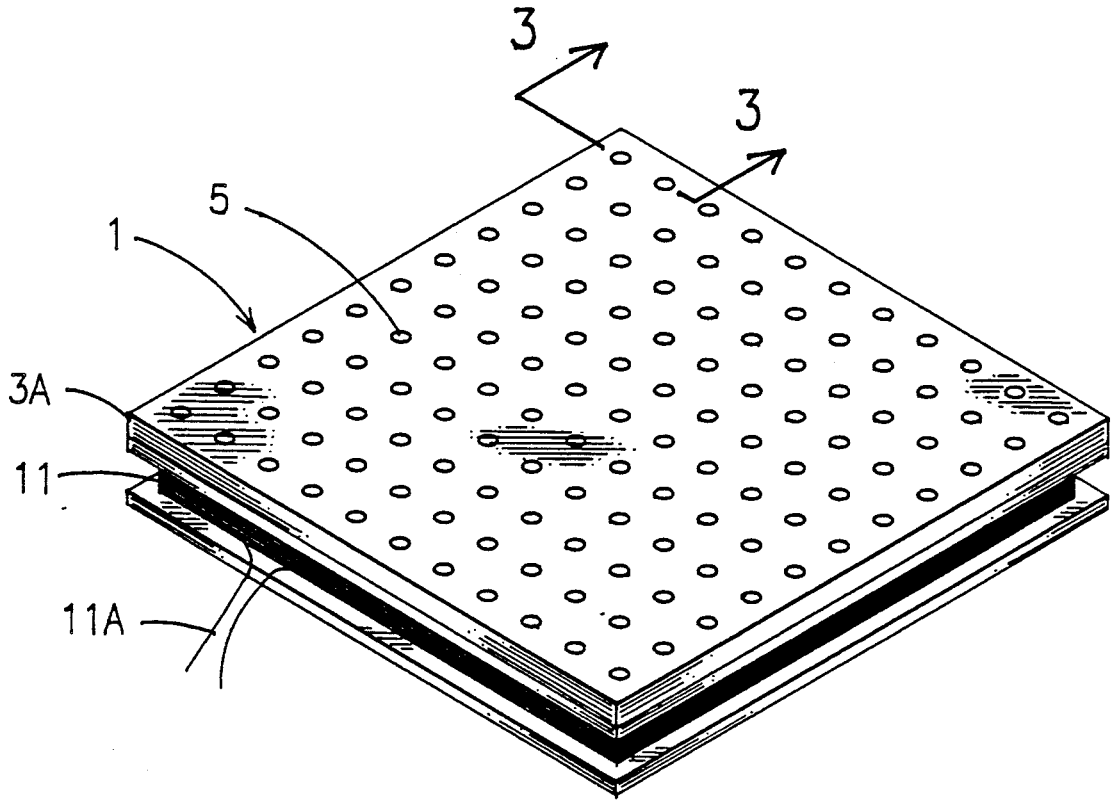
FIG. 2 is a perspective view of the base plate of the building block system.
Figure 3:
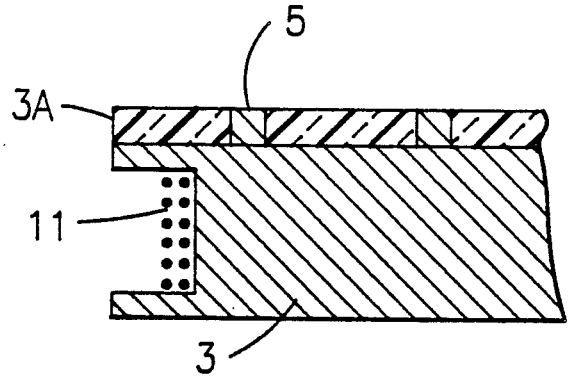
FIG. 3 is a sectional elevational view of FIG. 2 taken along line 3—3 of FIG. 2.

The invention will now be described in detail referring to the enclosed drawing which shows the principle of the building block system and some of the parts as a perspective and partly sectional drawing.

The building block system of the drawing comprises essentially a plane base plate 1 containing a metal core 3. The surface of the metal core is provided with protruding, peg-like, metallic joining elements 5. In the preferred embodiment, the joining elements have a circular cross-section; however, any suitable shape may be used. The space 6 between the joining elements is totally filled with an isolating material 3*a* formed of any suitable non-magnetic material, including but not limited to synthetic resins well known to those skilled in the art. The surface of the joining elements 5 farthest from the metal core 3 is flush with the surface of the isolating material 3*a*. Therefore, the surface 10 of the base plate 1 is completely smooth. The metallic joining elements 5 may be integrally formed with the metal core 3, or they may be individually attached in any manner known to those skilled in the art. In another embodiment the joining elements 5 may be formed in the isolating material 3*a*, in the same fashion that the elements 4 are formed in the building blocks 2, later described. The isolating material 3*a*, with the joining elements embedded therein, may then be rested upon or may be attached to the metal core 3 by bonding or any other suitable means.

Peg-like joining elements 5 in the base plate 1 are arranged according to a suitably chosen modular measure. For instance, the distance between the joining elements is equal to length M or a multiple thereof.

In the embodiment of FIG. 1, the building blocks 2 are pieces having a rectangular cross-section. Shape of the building blocks can, however, be chosen arbitrarily. Similarly, the material from which the building blocks can be constructed may be of any suitable material including, but not limited to, metals and synthetic resins.

There is at least one joining element 4 made of magnetizable metal and disposed inside the building block 2. Joining elements are peg-like form pieces, preferably having a circular cross-section and correspond, in shape and in cross-section, with the peg-like joining elements 5 of the base plate 1.

The joining element 4 of the building block is, in the case shown in FIG. 1, a piece extending through the building block 2. The end surfaces 7 and 8 of the joining element, which cross the longitudinal direction thereof, are flush with the first surface 9 and opposing second surface 14 of the block 2 so that the surfaces 9 and 14 of the building block 2 are completely smooth like the surface 10 of the base plate 1.

Disposition of the joining elements 4 in the building block naturally matches the modular division of the joining elements 5 in the base plate, according to the modular measure, so that this division, for instance, equals to the measure M in both directions.

For magnetizing the metal core, a coil 11 is wound around the core 3 in a U-shaped groove formed on the vertical sides of the core. The coil is connected to a DC power supply 12 preferably via a reversing switch 13. Direction of magnetization can be selected by means of the reversing switch. The DC power is preferably adjustable. As the metal core is magnetized, the joining elements 5 of the upper surface will, naturally, also be magnetized, attracting the corresponding joining elements 4 of the building block placed on the base plate. The joining elements of the building blocks will be magnetized and will become attached to the joining elements of the next block. Thus the structure will hold firmly together. When the current supply is switched off from the power supply 12, the magnetic forces holding the structure together will be released and the structure can be readily dismantled.

In addition, other methods can be used for magnetizing the base plate, e.g. a method wherein a U-shaped metallic form piece, which is electrically magnetized, is used so that the magnetic field formed in between the flanges of the U is brought close to the base plate. An essential feature of the invention is the fact that, since the building blocks contain magnetizable metallic parts only but no permanent magnets like in known solutions, the structure is easy to disassemble by merely switching off the current and furthermore the fact that the building blocks will not become entangled with each other when separate from the base plate.

What is claimed is:

1. A building block system comprising:

a base plate comprising;

a magnetizable metal core;

a plurality of joining elements comprised of metallic material attached to said core and disposed from one another by a modular measure, said joining elements having a surface which lies farthest from said core, non-magnetic isolating material attached to and covering said core, said isolating material having a surface distal said core, such that said surface of said joining elements of said base plate is flush with said surface of said isolating material such that said surface of said isolating material and said surface of said joining elements of said base plate create a smooth surface throughout;

a means for electrically magnetizing said core and said joining elements of said base plate; and a plurality of building blocks, each block having a first surface and at least one joining element that extends to said first surface of said building block.

2. A building block system according to claim 1 wherein said joining elements of said base plate comprise pegs that protrude from the surface of said metal core, said pegs having space therebetween, and wherein said isolating material fills said space between said pegs of said base plate.

3. A building block system as in claim 2 wherein each said peg of said base plate has a circular cross-section.

4. A building block system according to claim 1 wherein each said joining element of each said building block is configured as a peg.

5. A building block system according to claim 4 wherein each said peg of each said building block has a circular cross-section.

6. A building block system according to claim 1 wherein each said building block further comprises a second surface opposing said first surface and each said joining element of said building block comprises a pair of end surfaces, said joining element extending through said building block such that each said end surface of said joining element is flush with a corresponding one of said first and second surfaces of said building block such that said first and second surfaces of said building block are smooth throughout.

7. A building block system according to claim 1 wherein said building block contains a plurality of said joining elements, said distance between said joining elements being a modular measure.

8. A building block system according to claim 1 wherein said electrically magnetizing means comprises a coil wound around said core of said base plate, said coil being connected to a power supply via a switch.

9. A building block system according to claim 8 wherein said switch is a reversing switch.

* * * * *